US007014435B1

(12) United States Patent
Yanagisawa et al.

(10) Patent No.: US 7,014,435 B1
(45) Date of Patent: Mar. 21, 2006

(54) SCROLL FLUID MACHINE

(75) Inventors: Ken Yanagisawa, Yokohama (JP); Tamotsu Fujioka, Yokohama (JP)

(73) Assignee: Anest Iwata Corporation, (JP)

( * ) Notice: Subject to any disclaimer, the term of this patent is extended or adjusted under 35 U.S.C. 154(b) by 0 days.

(21) Appl. No.: 10/927,667

(22) Filed: Aug. 28, 2004

(51) Int. Cl.
*F04C 18/00* (2006.01)
*F03C 2/00* (2006.01)

(52) U.S. Cl. ..... 418/55.2; 418/55.4; 418/59; 418/101

(58) Field of Classification Search ..... 418/6, 418/59, 55.1–55.6, 101
See application file for complete search history.

(56) References Cited

U.S. PATENT DOCUMENTS 4,141,677 A * 2/1979 Weaver et al. ..... 418/6
6,506,512 B1 1/2003 Mori et al.
6,659,743 B1 * 12/2003 Kimura et al. ..... 418/6
6,682,328 B1 * 1/2004 Kimura et al. ..... 418/6
6,709,248 B1 * 3/2004 Fujioka et al. ..... 418/55.2

FOREIGN PATENT DOCUMENTS

JP 2003166484 A * 6/2003

* cited by examiner

*Primary Examiner*—Theresa Trieu
(74) *Attorney, Agent, or Firm*—Fulwider Patton LLP

(57) ABSTRACT

A scroll fluid machine comprises a stationary scroll and an orbiting scroll fitted on an eccentric portion of a driving shaft. The stationary scroll has a stationary end plate from which inner and outer stationary wraps project, and the orbiting scroll has an orbiting end plate from which inner and outer orbiting wraps project. Between the stationary and orbiting end plates, inner and outer annular partition walls are provided. Inside the inner partition wall, the inner stationary wrap is engaged with the inner orbiting wrap to form an expanding region, and between the inner and outer partition walls, the outer stationary wrap is engaged with the outer orbiting wrap to form a compressing region. A bore is formed through the orbiting end plate so that fluid expanded and cooled in the expanding region flows from the expanding region to rear surface of the orbiting end plate to cool the orbiting end plate.

5 Claims, 8 Drawing Sheets

SCROLL FLUID MACHINE

BACKGROUND OF THE INVENTION

The present invention relates to a scroll fluid machine having compressing and expanding regions, and especially to a scroll fluid machine connected to a fuel cell or used as an air expanding cooler.

In a fuel cell, electrolytes are put between an anode and a cathode. Hydrogen is fed as cell active material to the cathode. Electrons are released to create hydrogen ions and pass through an external circuit to the anode. Oxygen is fed to the anode and receives electrons from the external circuit. Oxygen ions react with hydrogen ions in the electrolytes to produce water. Thus, electrons flow from the cathode to the anode, or electric currents flows from the anode to the cathode.

Generally air that contains oxygen is fed to the anode, so that there are not only water but also unreactive oxygen and nitrogen which is main ingredient of air. To combine hydrogen with oxygen is exothermic reaction, so that temperature elevates from that of fed air. A gas that mainly contains nitrogen must be discharged from the anode.

Air pressurized by a compressor is fed to the anode, and the gas at the anode has higher pressure than atmospheric pressure. The gas is discharged to air and lost without doing work. Thus, the gas is fed to an expander to obtain energy retrieval. Hence, both compressor and expander are preferably, provided in the fuel cell.

U.S. Pat. No. 6,506,512 B1 to Mori et al. discloses a compression regenerative machine for a fuel cell, comprising a compressor and an expander in a single fluid machine. An orbiting scroll of the scroll fluid machine has a scroll wrap in each side. The scroll wrap in one side compresses sucked fluid, while the other-side scroll wrap expands the fluid to do work.

However, in the compression regenerative machine, the scroll wrap is provided on each side of the orbiting scroll to increase the length of the scroll. The orbiting scroll has at the center a bearing boss for supporting the orbiting scroll. So the scroll wrap is wound at the position outer than the outer circumference of the bearing boss to increase the external diameter of the scroll end plate. The wrap is provided on each side of the orbiting scroll thereby causing troublesome working.

SUMMARY OF THE INVENTION

In view of the disadvantages in the prior art, it is an object of the invention to provide a scroll fluid machine having both compressing and expanding regions, the machine having small-size and light-weight, manufacturing cost being reduced.

It is another object of the invention to provide a scroll fluid machine in which fluid fallen in temperature in an expanding region is utilized to effectively cool the scroll fluid machine and an electric motor for driving the scroll fluid machine.

BRIEF DESCRIPTION OF THE DRAWINGS

The above and other features and advantages of the present invention will become more apparent from the following description with respect to embodiments as shown in appended drawings wherein.

DETAILED DESCRIPTION OF THE PREFERRED EMBODIMENTS

Figure 1:
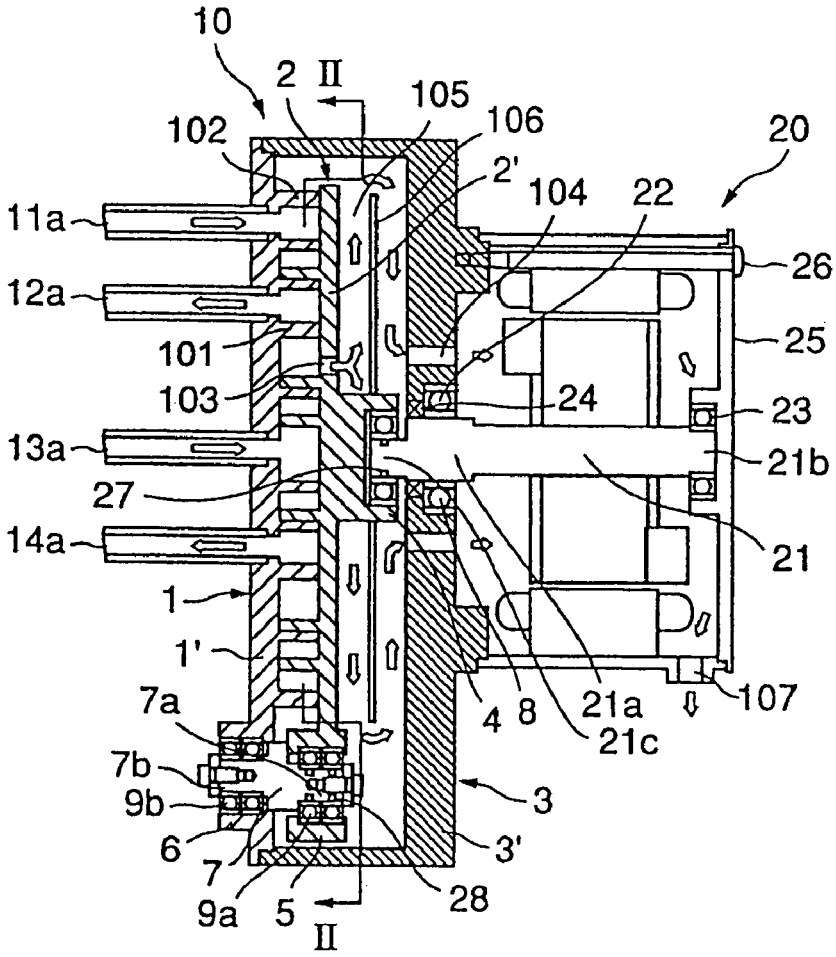
FIG. 1 is a vertical sectional side view of the first embodiment of a scroll fluid machine according to the present invention.
Figure 2:
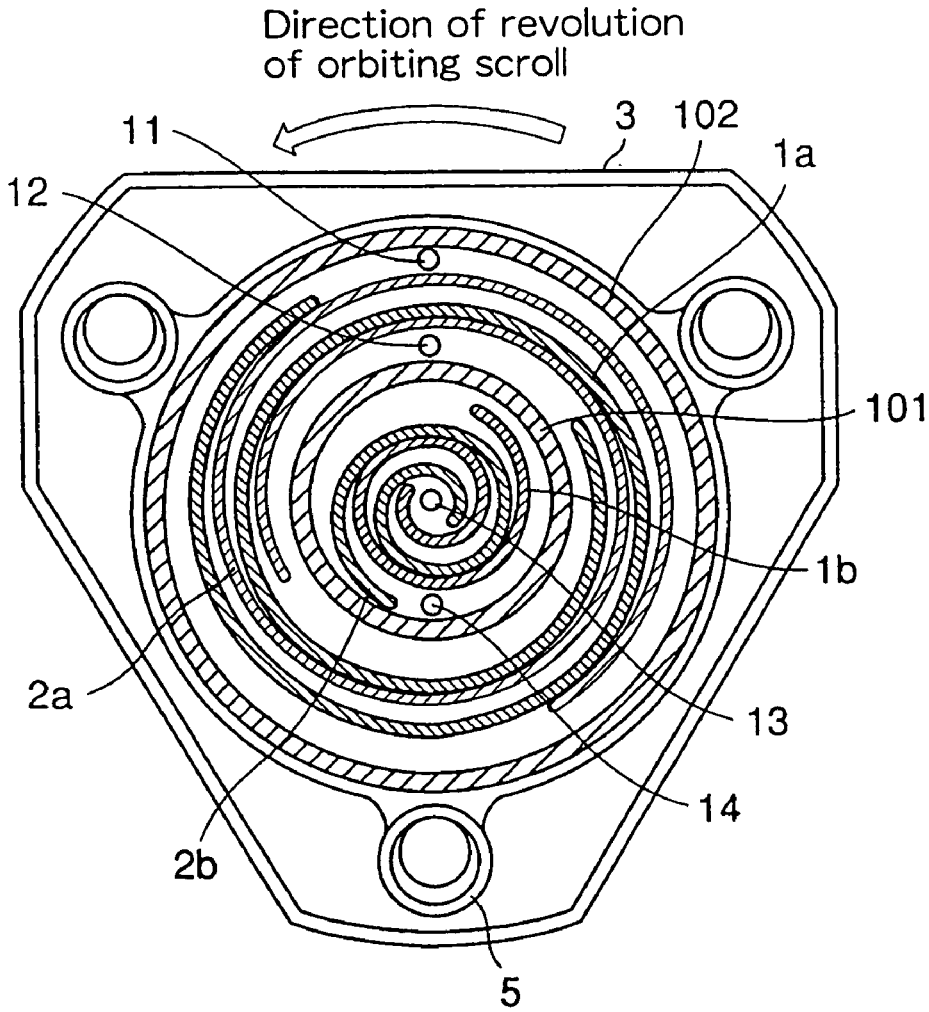
FIG. 2 is a sectional view taken along the line II—II in FIG. 1, from which an auxiliary crank shaft and bearings thereof are removed.

FIGS. 1 and 2 illustrate the first embodiment of a scroll fluid machine according to the present invention, comprising a scroll portion 10 and an electric motor 20. A stationary end plate 1' of a stationary scroll 1 has an inner annular partition wall 101; an outer annular partition wall 102; an outer stationary wrap 1*a* between the inner and outer partition walls 101 and 102; and an inner stationary wrap 1*b* inside the inner partition wall 101. An orbiting end plate 2' of an orbiting scroll 2 has an outer orbiting wrap 2*a* that engages with the outer stationary wrap 1*a*; and an inner orbiting wrap 2*b* that engages with the inner stationary wrap 1*b*. The orbiting scroll 2 is covered with a housing 3 fixed to the stationary scroll 1. An electric motor 20 is fixed to a wall 3' of the housing 3 by a bolt 26. Journals 21*a* and 21*b* of a driving shaft 21 of the electric motor 20 are rotatably supported by the housing 3 and a rear cover 25 of the electric motor 20 by bearings 8 and 23 respectively so that an axis of the driving shaft 21 may coincide with the center of the stationary scroll 1.

Three bosses 5 protrude near the outer periphery of the orbiting scroll 2 like an equilateral triangle, and a pin 7*a* at one end of an auxiliary crank 7 is rotatably supported in each of the bosses 5 via a bearing 9*a*. There are provided three bosses 6 on the stationary scroll 1 and a pin 7*b* at the other end of the stationary scroll 1 in each of the bosses 6 via a bearing 9*b*. The pins 7*a*, 7*b* are provided eccentrically by a certain amount. An eccentric portion 21*c* is formed at one end of the driving shaft 21 and supports a boss 4 at the center of the rear surface of the orbiting end plate 2' via a bearing 22. The eccentric portion 21*c* has the same eccentricity as that of the pins 7*a*,7*b* of the auxiliary crank 7.

Numeral 24 denotes a seal, and 27,28 denote elastic rings. When an inner ball of the bearing is loosened from the eccentric portion 21*c* so as to facilitate the eccentric portion 21*c* to insert into the bearing 8 of the orbiting scroll, the elastic rings 27,28 prevent fretting corrosion owing to rotation of the inner surface of the inner ball of the bearing on the outer circumference of the pin portion 21*c*.

For example, when the elastic ring 27 made of hard rubber is fitted in a bore of the eccentric portion 21*c*, the elastic ring 27 prevents the inner ball from rotating on the eccentric portion 21*c* owing to friction after fitting of the inner ball while resistance is small during fitting of the inner ball. Similarly, the elastic ring 28 facilitates the pin portion 7*a* of the auxiliary crank 7 to insert into the bearing 9*a* of the orbiting scroll 2 and prevents the inner ball of the bearing 9*a* from sliding.

On the end plate 1' of the stationary scroll 1, there are a compressing portion inlet 11 inside the outer partition wall 102; a compressing portion outlet 12 outside the inner partition wall 101; an expanding portion outlet 14 inside the inner partition wall 101; and an expanding portion inlet 13 at the center. Pipes 11*a*,12*a*,14*a*,13*a* are connected to the holes 11,12,14,13 respectively. When the electric motor 20 is rotated in a counterclockwise direction seen from the right in FIG. 1, the orbiting scroll 2 is revolved in the counterclockwise direction around the center of the stationary scroll 1 as shown in FIG. 2 while the orbiting scroll 2 is prevented from rotation around its own axis. Thus, a compressing region is created between the inner and outer partition walls 101 and 102, and an expanding region is created inside the inner partition wall 101.

Fluid is sucked through the inlet 11, compressed in the compressing region by engagement of the outer scroll wraps 1 *a* and 2*a* between the inner and outer partition walls 101 and 102 and discharged through the outlet 12. Fluid is sucked through the inlet 13, expanded in the expanding region by engagement of the inner scroll wraps 1 *b* and 2*b* inside the inner partition wall 101 and discharged through the outlet 14.

The orbiting scroll end plate 2' has an expanded fluid discharge bore 103 communicating with the expanding region, and an blocking plate 106 is provided behind the orbiting scroll end plate 2'. The blocking plate 106 is fixed to the orbiting scroll end plate 2' by bonding it to a cooling fin 105 and other means. The fluid expanded in the expanding region is discharged not only through the outlet 14 of the stationary scroll end plate 1' but also through the discharge bore 103 of the orbiting scroll end plate 2'. The expanded fluid discharged through the discharge bore 103 passes between the rear surface of the orbiting scroll 2 and the blocking plate 0.106 toward the outer circumference to cool the orbiting scroll 2, turns at the outer circumference of the blocking plate 106, flows between the blocking plate 106 and the wall plate 3' of the housing 3 toward the center and flows into the electric motor 20 through a bore 104 of the wall plate 3' of the housing 3. The fluid that cools the electric motor 20 is discharged to the outside through the outlet 107.

If the expanded fluid does not cool the electric motor 20, the fluid may be discharged through an outlet of the housing 3 without the blocking plate 106 or bore 104 of the wall plate 3'. The compressing region is partitioned by the outer partition wall 102 to prevent the fluid from flowing out of the compressing region to the back of the orbiting scroll 2.

The inlet and outlet of fluid in the compressing region and the inlet and outlet of fluid in the expanding region are all formed on the front face of the stationary scroll, thereby avoiding conduits which project on the outer circumference of the housing 3 and preventing the external diameter of the scroll machine 10 from becoming larger owing to the conduits. It is advantageous in providing the scroll fluid machine in a motor vehicle where space is limited.

In FIGS. 1 and 2, the inlets and outlets are circular, but may be other shapes by which required sectional area is obtainable. The inlets and outlets on the front face of the stationary scroll end plate allow the external diameter of the scroll fluid machine to become smaller and allows conduits to be ordered clearly, thereby providing good appearance.

Figure 4:
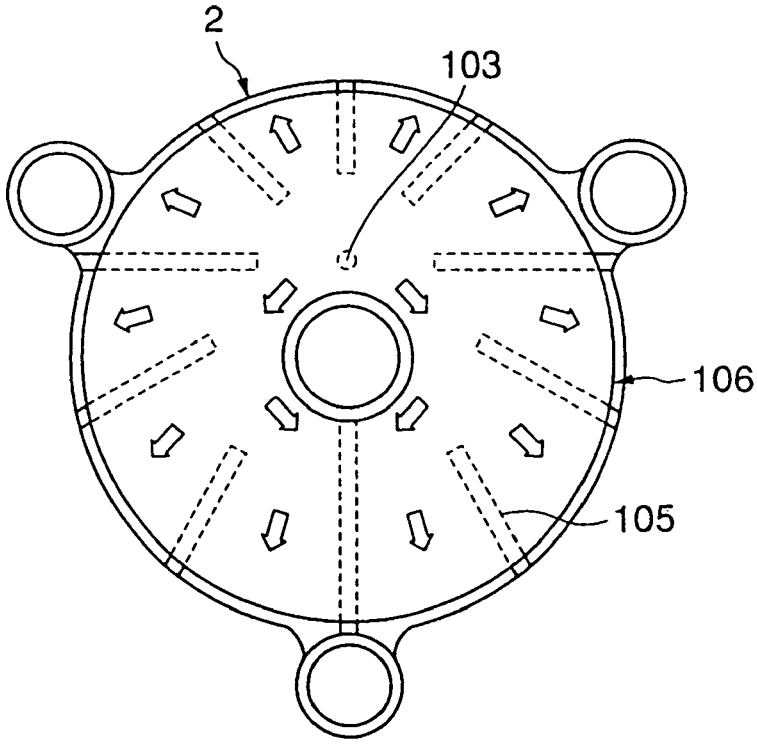
FIG. 4 is a front view of an example of an orbiting scroll cooling fin in the first embodiment.

The cooling fin behind the orbiting scroll end plate 2' may be various shapes. FIG. 4 is a rear view of the orbiting scroll 2 and one example of the shape of the cooling fin. The fluid fallen in temperature in the expanding region is discharged through the discharge bore 103 of the orbiting scroll 2 and flows along the cooling fin 105 to cool the orbiting scroll 2.

Figure 5:
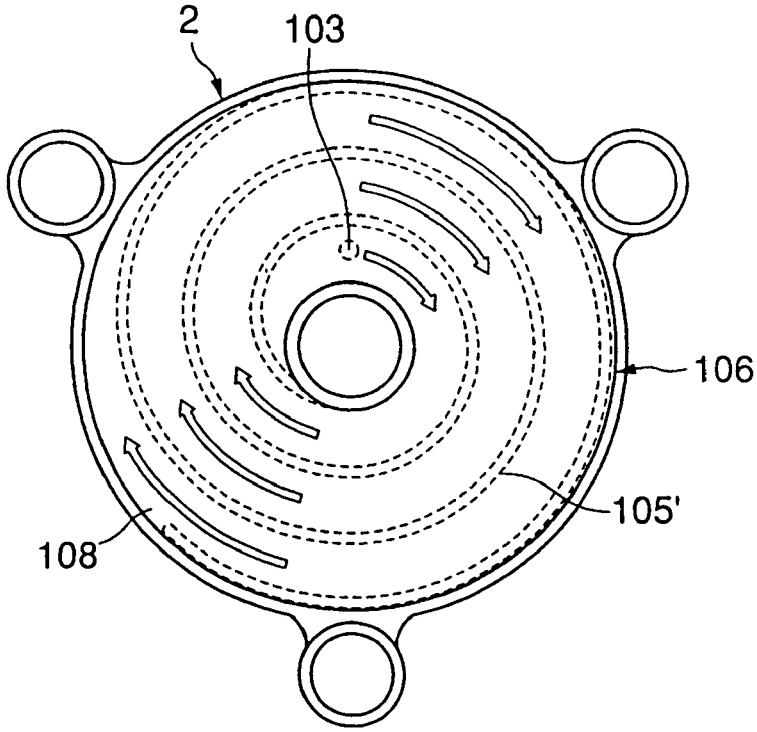
FIG. 5 is a front view of another example of an orbiting scroll cooling fin in the first embodiment.

When the scroll fluid machine is used for a fuel cell, a gas discharged from the fuel cell and sucked through the inlet 13 has raised temperature with reaction heat in the fuel cell, but the gas discharged from the outlet 103 has fallen temperature with expansion in the expanding region and can be used as cooling fluid, FIG. 5 illustrates another embodiment of a cooling fin in an orbiting scroll. In this embodiment, the cooling fin 105' is spiral, and fluid through a discharge bore 103 flows through a spiral path made by the cooling fin to cool an orbiting scroll and flow out of an outlet 108 of the spiral path. The cooling fin also reinforces the orbiting scroll.

Figure 3:
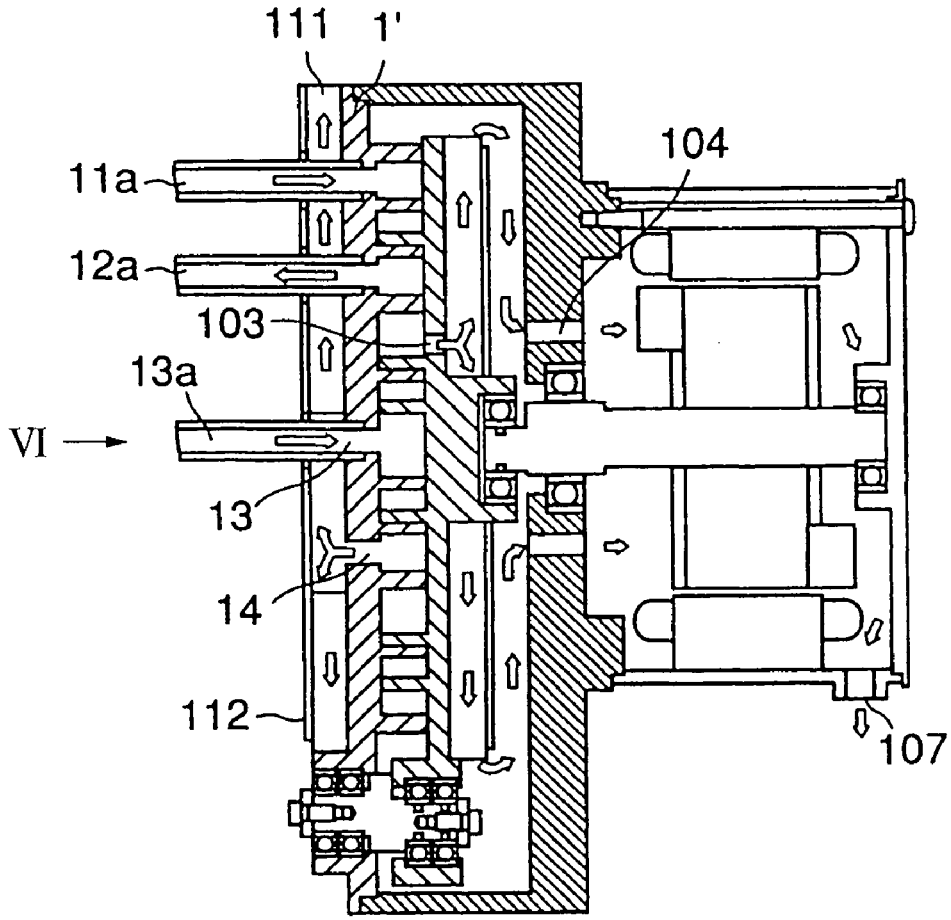
FIG. 3 is a vertical sectional side view of the second embodiment of a scroll fluid machine according to the present invention.

FIG. 3 shows an embodiment similar to that in FIG. 1 except that a cooling fin 111 and a front blocking plate 112 are provided in front of a stationary scroll end plate 1' so that fluid discharged through an outlet 14 from an expanding region flows along the cooling fin between the front blocking plate and the stationary scroll end plate. The same structure is omitted.

In FIG. 3, the cooling fin 111 is provided in front of the stationary scroll end plate 1, and the front blocking plate 112 is contacted with the top surface of the cooling fin 111. The front blocking plate 11 may be bonded to the cooling fin 111 by adhesive or may be fixed to the stationary scroll end plate 1' by a screw. Between pipes 11*a*,12*a*,13*a* and bores through which the pipes pass in the front blocking plate 112, a gap is not formed by a rubber grommet to prevent fluid from leaking not to decrease cooling efficiency.

Figure 6:
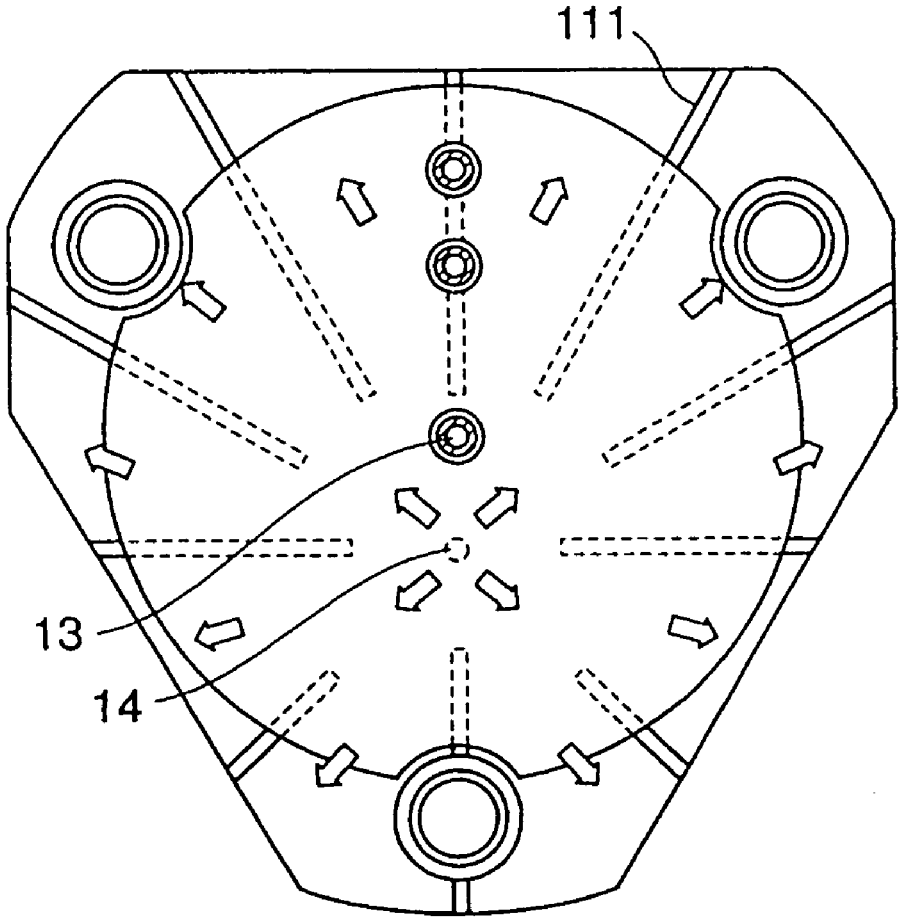
FIG. 6 is a view seen from an arrow VI in FIG. 3, showing a stationary scroll cooling fin in the second embodiment of the present invention.

The stationary scroll cooling fin may be various shapes. FIG. 6 is a view seen from an arrow VI in FIG. 3 and shows one example of the front shape of the cooling fin. Fluid fallen in temperature in the expanding region is discharged through the outlet 14 and flows along a radial cooling fin 111. After cooling the stationary scroll, it is discharged to the outside.

When the scroll fluid machine is used for a fuel cell, a gas discharged from the fuel cell and sucked into the expanding region through an inlet 13 is raised in temperature owing to reaction heat in the fuel cell, but is fallen with expansion in the expanding region of the scroll fluid machine. It can be used as cooling fluid.

Figure 7:
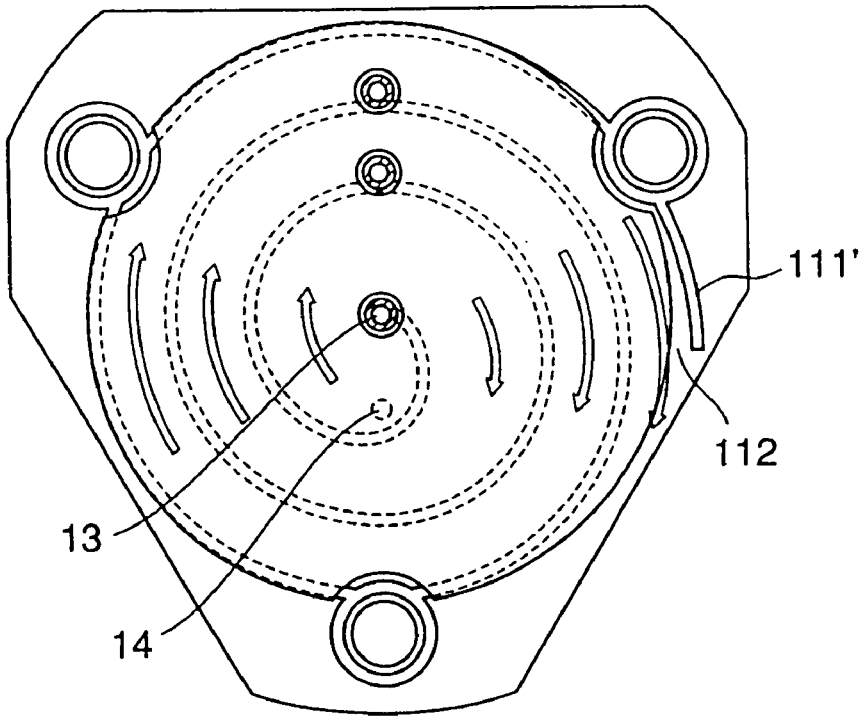
FIG. 7 is a front view of further example of a stationary scroll cooling fin in the second embodiment.

FIG. 7 illustrates further example of a front shape of a cooling fin of a stationary scroll. In the example, the cooling fin 111' is spiral and fluid discharged though an outlet 14 passes through a spiral path formed by the cooling fin 111' to an outlet 112 of the spiral path 112.

When the scroll fluid machine is used in an air expanding cooler, air that cools the stationary scroll and comes to the outlet 112 of the spiral path can be fallen to very low temperature, so that air discharged though the outlet 112 can be employed as cooling air.

Figure 8:
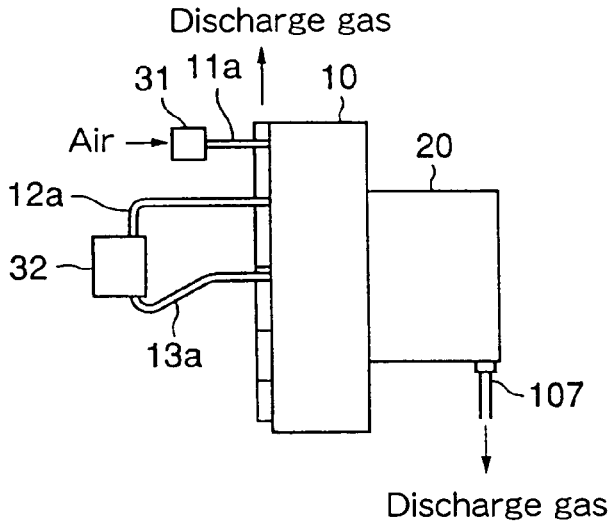
FIG. 8 is a schematic view of a pipe line when the scroll fluid machine in the second embodiment is used in a fuel cell.

FIG. 8 schematically illustrates a pipe line in which the scroll fluid machine in FIG. 3 is used in a fuel cell. Air cleaned through an air filter 31 is sucked into the scroll fluid machine 10 through a pipe 11*a*, compressed in the compressing region and transferred under pressure to an anode of a fuel cell 32 through a pipe 12*a*. The air is cooled on the way of transfer, if necessary. A gas from the fuel cell 32 is sucked into the center of the scroll through a pipe 13, expanded in the expanding region of the scroll fluid machine 10 and discharged from a pipe 14*a*.

As mentioned above, a gas sucked into the expanding region from the fuel cell 32 is expanded in the expanding region to apply rotational force to the orbiting scroll to help compression in the compressing region, so that compression in the compressing region is partially retrieved. The discharged gas fallen in temperature with expansion in the expanding region is partially discharged through the outlet 14 to cool the stationary scroll and discharged to the outside. The remainder of the gas flows out of the discharge bore 103 of the orbiting scroll to the back of the orbiting scroll end plate 2'. After cooling the orbiting scroll, it flows into the electric motor 20 through the bore 104 of the housing and is discharged to the outside through the outlet 107. The scroll fluid machine in FIG. 1 can be applied to a fuel cell.

Figure 9:
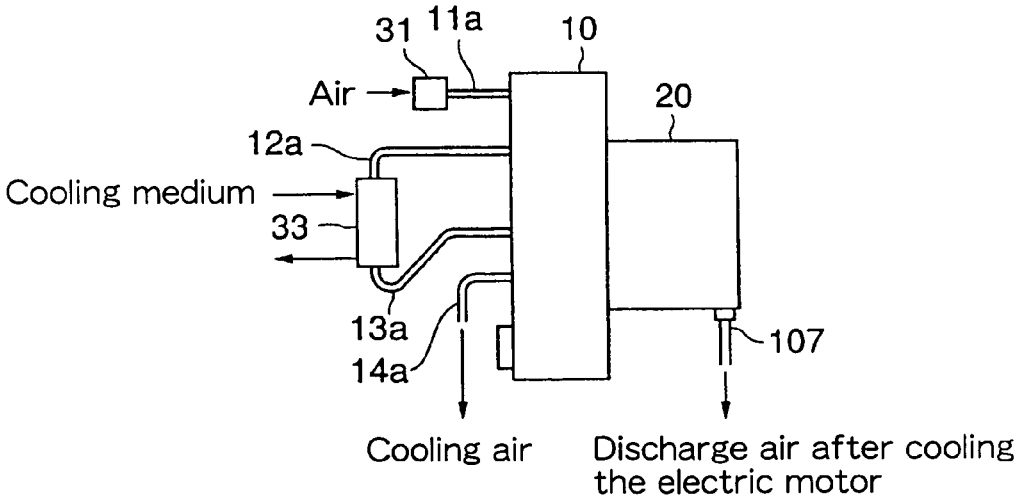
FIG. 9 is a schematic view of a pipe line when the scroll fluid machine in the first embodiment is used in an air expanding cooler.

FIG. 9 schematically illustrates a pipe line when the scroll fluid machine in FIG. 1 is used in an air expanding cooler. Instead of the fuel cell in FIG. 8, an air cooler 33 is disposed. Air compressed in the compressing region of the scroll fluid machine 10 is introduced into the air cooler 33 and cooled by heat exchange with cooling medium. The cooled air is introduced into the expanding region of the scroll fluid machine 10. As a result of working of the air to the orbiting scroll, expanded air discharged through the pipe 14*a* from the outlet 14 has lower temperature than air sucked through the air filter 31, and is used as cooler.

Air expanded in the expanding region partially flows through the discharge bore 103 to the back of the orbiting scroll. After cooling the orbiting scroll, it is introduced into the electric motor 20 and discharged to the outside through the outlet 107 after cooling to the electric motor. The scroll fluid machine in FIG. 3 is also applied to an air-expanding cooler.

Figure 10:
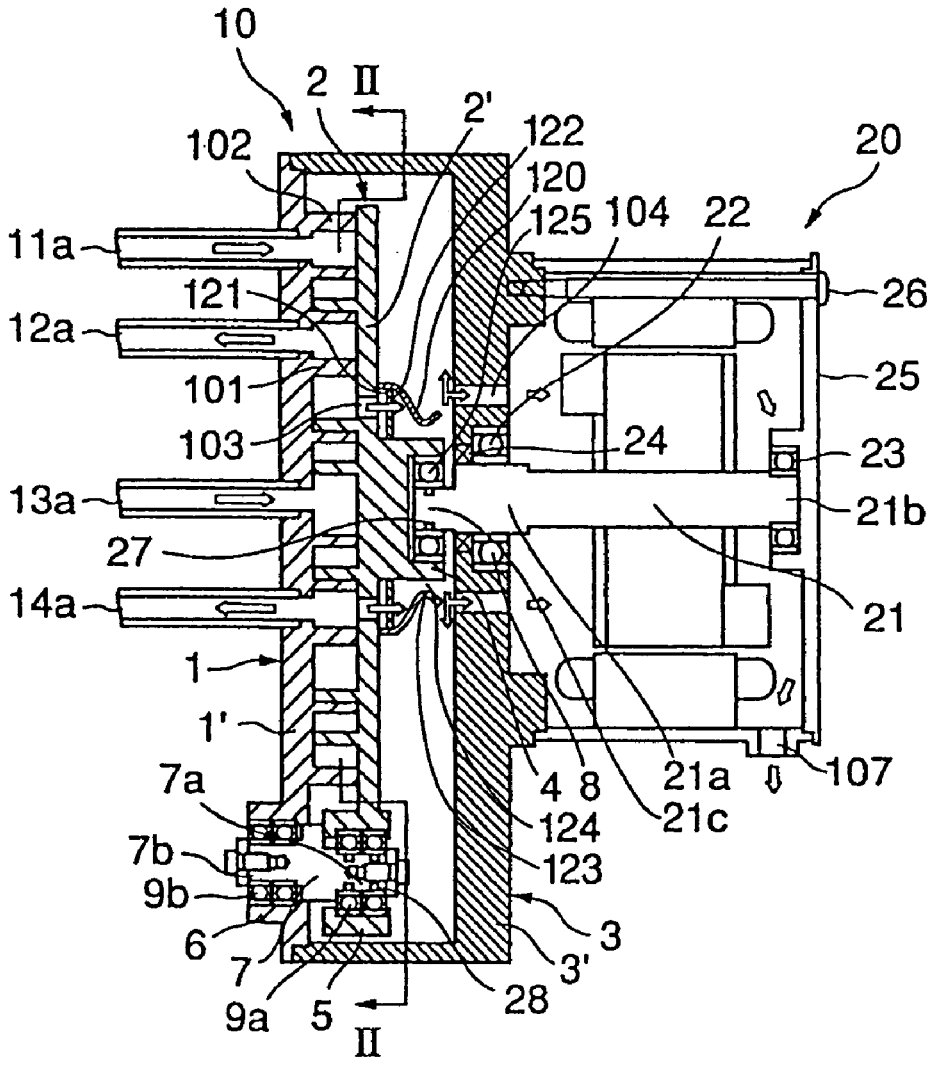
FIG. 10 is a vertical sectional side view of the third embodiment of a scroll fluid machine according to the present invention.

FIG. 10 illustrates the third embodiment of a scroll fluid machine according to the present invention, in which an expanding cover 120 is mounted to the rear surface of an orbiting end plate 2' to surround a boss 4. Fluid already expanded in an expanding region between an inner stationary wrap 1*b* and an inner orbiting wrap 2*b* flows through a discharge bore 103 and an annular bore 122 of an annular support plate 121 for supporting the expanding cover 120. The fluid passes through a narrower space 124 between an inward-projecting portion 123 and the boss 4. In the narrower space 124, the fluid becomes faster and gives lower pressure to become lower temperature. A central bearing 125 driven by a driving shaft 21 is likely to heat and to wear owing to friction. By the lower-temperature fluid that passes near the central bearing 125, the central bearing 125 is cooled, so that durability is increased. Thereafter, the fluid flows through a bore 104 to an electric motor 20 to cool it and to the rear surface of the orbiting end plate 2' to cool it.

The foregoing merely relates to embodiments of the invention. Various changes and modifications may be made by a person skilled in the art without departing from the scope of claims wherein:

What is claimed is:

1. A scroll fluid machine comprising:

a driving shaft having an eccentric portion;

a housing;

a stationary scroll having a stationary end plate from which an inner stationary wrap and an outer stationary wrap project, said stationary end plate being part of the housing;

an orbiting scroll having an orbiting end plate from which an inner orbiting wrap and an outer orbiting wrap project, the orbiting scroll being fitted on the eccentric portion of the driving shaft and driven by the driving shaft to revolve eccentrically with respect to the stationary scroll;

an inner annular partition wall mounted to the stationary end plate, said inner orbiting wrap being revolved by the driving shaft to engage with said inner stationary wrap inside the inner partition wall to form an expanding region; and an outer annular partition wall mounted to the stationary end plate, said outer orbiting wrap being revolved by the driving shaft to engage with said outer stationary wrap between the inner and outer partition walls to form a compressing region;

a first outlet for discharging the first fluid in the compressing region;

a second outlet for discharging the second fluid in the expanding region;

a first inlet for introducing first fluid which is formed at part radially outer than the first outlet;

a second inlet for introducing second fluid which is formed at part radially inner than the second outlet; and a discharge bore which is formed through the orbiting end plate so that the second fluid expanded and cooled in the expanding region flows partially through the discharge bore to a rear surface of the orbiting end plate to cool the orbiting end plate.

2. A scroll fluid machine as claimed in claim 1 wherein a blocking plate is mounted to a boss of the orbiting end plate whereby the second fluid flows outwardly from the discharge bore for effective cooling to the orbiting plate.

3. A scroll fluid machine as claimed in claim 1 wherein a wall of the housing between the orbiting scroll and an electric motor for driving the driving shaft has a hole so that the second fluid flows to the electric motor to cool it.

4. A scroll fluid machine as claimed in claim 1 wherein the second fluid flows through the second outlet from the expanding region to a front of the stationary end plate to cool the stationary end plate.

5. A scroll fluid machine as claimed in claim 1 wherein an expanding cover is mounted to the orbiting end plate to surround a boss of the orbiting end plate, the expanding cover having an inward-projecting portion to form a narrower space between the expanding cover and the boss, fluid from the discharge bore from the expanding portion being depressurized and further cooled when it passes through the narrower portion.

* * * * *

UNITED STATES PATENT AND TRADEMARK OFFICE

CERTIFICATE OF CORRECTION

PATENT NO. : 7,014,435 B1
APPLICATION NO. : 10/927667
DATED : March 21, 2006
INVENTOR(S) : Ken Yanagisawa et al.

It is certified that error appears in the above-identified patent and that said Letters Patent is hereby corrected as shown below:

Column 3, line 47, delete "0.106" and insert --106--.

Signed and Sealed this

Eighth Day of August, 2006

JON W. DUDAS
*Director of the United States Patent and Trademark Office*